US008858722B2

(12) United States Patent
Cull

(10) Patent No.: US 8,858,722 B2
(45) Date of Patent: Oct. 14, 2014

(54) CONTAINER CLEANING AND RECHARGING METHOD AND APPARATUS

(75) Inventor: David Cull, Bankok (TH)

(73) Assignee: Joseph Company International, Inc., Irvine, CA (US)

( * ) Notice: Subject to any disclaimer, the term of this patent is extended or adjusted under 35 U.S.C. 154(b) by 221 days.

(21) Appl. No.: 13/698,609

(22) PCT Filed: May 17, 2011

(86) PCT No.: PCT/US2011/036804

§ 371 (c)(1),
(2), (4) Date: Feb. 6, 2013

(87) PCT Pub. No.: WO2011/146481

PCT Pub. Date: Nov. 24, 2011

(65) Prior Publication Data

US 2013/0125928 A1 May 23, 2013

Related U.S. Application Data

(60) Provisional application No. 61/345,428, filed on May 17, 2010.

(51) Int. Cl.

| | |
|---|---|
| ***B08B 9/28*** | (2006.01) |
| ***B08B 9/02*** | (2006.01) |
| ***B08B 9/08*** | (2006.01) |
| *F25B 45/00* | (2006.01) |
| *F25D 5/00* | (2006.01) |

(52) U.S. Cl.

CPC . *B08B 9/02* (2013.01); *F25B 45/00* (2013.01); *F25D 5/00* (2013.01); *B08B 9/0804* (2013.01)

USPC ..... 134/22.18

(58) Field of Classification Search

CPC ..... B08B 9/28; B08B 9/283

USPC ..... 134/22.18

See application file for complete search history.

(56) References Cited

U.S. PATENT DOCUMENTS

| | | | | |
|---|---|---|---|---|
| 4,206,631 | A | 6/1980 | Nysse et al. | |
| 5,441,063 | A | 8/1995 | Fernandez et al. | |
| 6,339,931 | B1 * | 1/2002 | Cull | 62/77 |

OTHER PUBLICATIONS

International Search Report, PCT/US2011/036804, mailed Aug. 22, 2011.

* cited by examiner

*Primary Examiner* — Michael Barr
*Assistant Examiner* — Caitlin N Dunlap
(74) *Attorney, Agent, or Firm* — Novak Druce Connolly Bove + Quigg LLP

(57) ABSTRACT

An apparatus and method for cleaning, sanitizing and recharging a self chilling container having a heat exchange unit including compressed carbon internally thereof including a plurality of sources of cleaning and sanitizing materials connected through a plurality of valves to the container for injecting and exhausting the materials into and from the container. A source of carbon dioxide gas to be injected into said heat exchange unit to be adsorbed by said carbon. A source of chilled fluid and means for circulating the chilled fluid through the container during adsorption of said carbon dioxide gas to remove heat generated thereby.

4 Claims, 5 Drawing Sheets

CONTAINER CLEANING AND RECHARGING METHOD AND APPARATUS

BACKGROUND OF THE INVENTION

1. Field of the Invention

The present invention relates to the cleaning of various containers which are used to hold beverages of various kinds and from which the beverage is dispensed to the customer and particularly to the cleaning and sanitizing of the interior surfaces of such containers.

2. Description of Prior Art

While not limited thereto in its utility, the present invention is particularly well suited for use in the cleaning of the internal surfaces of beer kegs. Such kegs are typically provided with a fitting which remains in one end of the keg. This fitting includes the usual check valves which permit the keg to be charged and subsequently emptied. The fitting also includes a riser pipe or spear which extends from the fitting to a point adjacent the opposite end of the keg. The present invention is specifically directed to such a keg which includes a heat exchange unit secured permanently internally thereof which when activated provides a self cooling of the beverage contained within the keg, for example, beer. This eliminates the necessity of maintaining the keg in a refrigerated area and allowing the contents of the keg to be dispensed without the necessity of refrigerated rooms or refrigeration units disposed at the point where the beer is drawn from the keg to be served to a customer.

The obtaining of satisfactory cleaning of such containers and particularly of beer kegs subsequent to their use is a problem of long standing in the art. Various techniques have been invented in an attempt to solve this problem. One such technique is the utilization of a cleaning fluid which is injected to wash the internal keg surfaces through the keg fitting riser pipe and is injected into the barrel or keg under pressure from the end of the riser pipe. The thus injected cleaning fluid will be deflected off of the bottom of the keg which faces the open end of the riser pipe and then will flow down the inside wall of the keg. The cleaning action which is achieved is enhanced by imparting a suitable shape to the interior wall of the keg. The cleaning fluid is removed from the keg via the passage in the keg fitting through which compressed gas is introduced during normal usage. The degree of cleaning achieved with this technique depends on several factors; such as design of the keg, the distance between the end of the riser pipe and the facing keg wall, the pressure of the cleaning fluid and the quantity of the cleaning fluid. Because it is not typically possible to accurately control all of these variables the desired cleaning and sterilizing effect has not always been achieved. Another problem exists in that it is very difficult to obtain cleaning of the exterior surface of the riser pipe or spear and such has been attempted by reducing the pressure of the cleaning fluid delivered at the end of the cleaning cycle to allow the fluid to flow down the exterior surface the spear.

In order to more effectively obtain cleaning an additional technique has been attempted and is referred to as interval cleaning which requires the modulation of a supply of compressed air such that the air is injected into the cleaning fluid being delivered through the riser pipe in bursts or slugs. This results in the introduction of the cleaning fluid into the keg from the riser pipe in the form of discharges which resemble explosions with the result being that annular shock waves will run along the keg wall from top to bottom. This technique has also proven to be unsatisfactory since there is no way to ensure that all parts of the interior of the keg will be washed by the cleaning fluid.

An additional technique has been to alternately introduce the cleaning fluid through the riser pipe and the keg fitting housing and then to introduce the cleaning fluid through the compressed gas and supply valve of the keg fitting. It is contemplated that when the cleaning fluid is introduced into the keg by way of the compressed gas valve. The fluid will also wash the outer surface of the riser pipe.

Still yet another example of a method and apparatus for cleaning the interior surface of a beverage keg is to introduce the cleaning fluid into the interior surface of the keg and then to set it in turbulent motion by injection of a gaseous or vaporous medium from beneath the surface of the thus introduced cleaning liquid. In addition, the cleaning fluid may be introduced in increments such that the level of the cleaning fluid internally of the keg is increased in step-wise fashion. The gaseous or vaporous medium which causes the turbulence in the cleaning fluid is injected between the incremental steps of addition of cleaning fluid. It is also contemplated to simultaneously inject the cleaning fluid and the gaseous medium into the interior part of the keg to be cleaned.

All of the known prior art processes and apparatus for use in cleaning containers and particularly kegs have one or more deficiencies. The common characteristic of the prior art techniques has been the lack of the ability to ensure that all interior surfaces of the keg can be cleaned and will be contacted by the cleaning fluid. Furthermore, none of the prior art techniques included any means for recharging a self-contained heat exchange unit with a compressed gas such as carbon dioxide as an extension of the cleaning cycle, that is, at the conclusion thereof.

SUMMARY OF THE INVENTION

The present invention overcomes the above discussed and other deficiencies and disadvantages of the prior art by providing a novel and improved apparatus and method for the internal cleaning of containers such as kegs whereby the cleaning and sterilization thereof is achieved in an effective and reliable manner and in a comparatively short period of time. The present invention also provides the ability to recharge the heat exchange unit as an extension of the cleaning cycle with an appropriate gaseous medium such as carbon dioxide to be adsorbed by compressed activated carbon particles disposed within the heat exchange unit. In accordance with the present invention the keg is loaded unto a platform with the keg fitting or opening disposed in a downwardly direction. The fitting is connected to a fluid conduit which in turn is connected through a junction to a conduit for receiving various cleaning and sanitizing fluids which are to be injected internally into the keg and exhausted therefrom by sequentially opening and closing valves. Chilled water is circulated through the container and the carbon dioxide gas is injected into the heat exchange unit while the chilled water is being circulated to remove heat generated by the carbon dioxide gas being adsorbed onto the carbon.

In accordance with the method of the present invention, after the keg is mounted on the platform it is charged with a gas under pressure such as air to remove the residual beer which may be in the keg. At the same time since the keg is pressurized it can be tested to be sure that it is leak proof. Subsequently, the air is allowed to escape from the keg and steam under pressure is inserted to kill any residual bacteria. Thereafter a caustic solution is injected internally of the keg through the riser to wash the interior surface of the keg with the caustic solution to sterilize the same. The caustic solution is then removed from the interior of the keg by washing the interior of the keg with the subsequent injection of water. Chilled water is then circulated through the keg and while the chilled water is being circulated through the keg and is maintained in a chilled condition by being circulated through an appropriate chilling device, the heat exchange unit is charged with an appropriate medium such as carbon dioxide. The recycled cold water flowing through the interior of the keg removes the heat generated by charging the heat exchange unit with the carbon dioxide which is an exothermic process.

The apparatus provided in accordance with the present invention includes a platform upon which the empty keg is mounted, a plurality of connections are provided to the keg fitting, and the gas inlet valves used to charge the heat exchange unit, a plurality of valves are connected to a plurality of sources of cleaning and sanitizing materials as well as to a source of carbon dioxide, means is provided to activate or deactivate the plurality of valves in a predetermined sequence to apply the desired cleaning and sanitizing materials to the interior of the keg and to the apply the carbon dioxide charging gas to the heat exchange unit, and means is provided to circulate chilled water through the interior of the keg during the carbon dioxide charging cycle to remove the heat generated by the exothermic reaction during the charging cycle.

DETAILED DESCRIPTION OF THE DRAWINGS

An apparatus and method of the present invention is useful to clean kegs which contain beverages of various types both carbonated and non-carbonated and those which are non-alcoholic and which also contain alcohol. The present invention is particularly useful for cleaning and recharging kegs which contain internally thereof a heat exchange unit which is charged with a compressed gas such as carbon dioxide which is used to cool the beverage contained within the keg on demand. Such a heat exchange unit includes compressed carbon particles such as activated carbon which adsorbs carbon dioxide gas under pressure and upon demand desorbs the carbon dioxide gas. Upon release and desorption of the carbon dioxide gas the beverage contained within the keg is cooled to a temperature which makes the beverage more palatable for consumption. Kegs of this type are particularly useful in areas where there is a lack of refrigeration or alternatively refrigeration is not readily available and yet the consumption of the beverage is desired. Such kegs would typically be fairly expensive to manufacture and thus would be reused a number of times. Since the kegs would be reused, it becomes imperative that after the beverage has been effectively exhausted from the keg that the interior of the keg be cleaned and sterilized before it is refilled with the desired beverage. At the same time during the cleaning cycle, the heat exchange unit would be recharged with the carbon dioxide by inserting the carbon dioxide under pressure into the heat exchange unit to be adsorbed by the compressed carbon particles. Such kegs could be reused several times so long as the appropriate cleaning, sanitizing and recharging is accomplished. The present invention is particularly useful to accomplish such cleaning, sanitizing and recharging.

Figure 1:
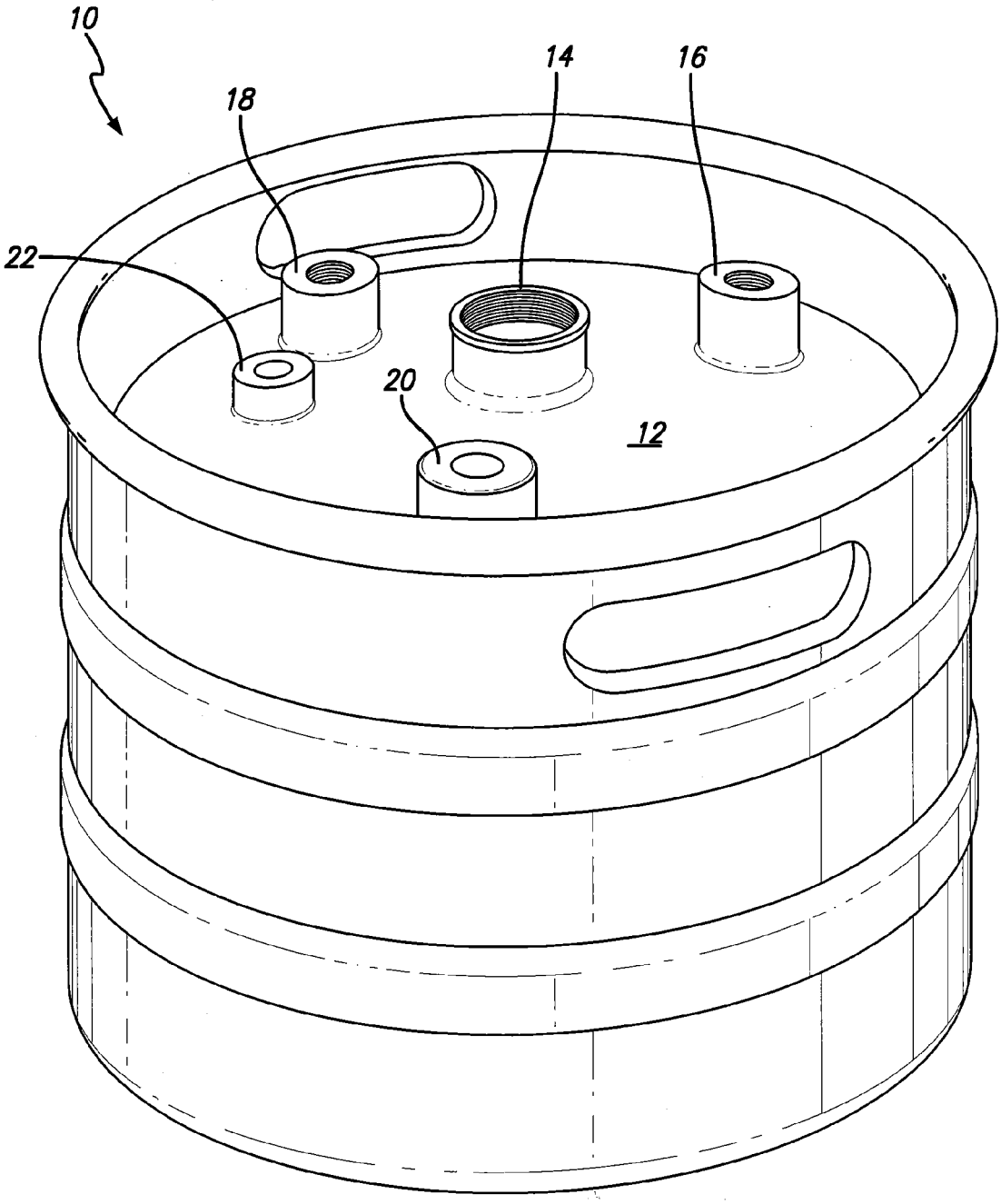
FIG. 1 is a perspective view of a keg of the type to be cleaned in accordance with the principles of the present invention.

The keg 10 of the type above described is illustrated in FIG. 1 and includes a top 12. The top 12 defines a spear or riser opening 14 to which is typically connected the spear or riser which is inserted into the barrel and extends downwardly to adjacent the bottom thereof and is used to draw the contents of the keg through an appropriate dispensing spout or the like (not shown in FIG. 1 but well known to those skilled in the art). Gassing valves 16, 18 and 20 are connected to gas feed tubes extending downwardly into the interior of the keg 10 and communicating with the heat exchange unit. These valves, 16, 18 and 20 are utilized to charge the heat exchange unit by injecting carbon dioxide under pressure into the heat exchange unit to be adsorbed by the compacted activated carbon particles contained therein. These valves are also utilized to release the carbon dioxide under pressure from the heat exchange unit as it is desorbed from the compressed carbon to cool the contents of the keg. In addition, a valve 22 is also utilized and is connected to a dispensing gas outlet which is utilized through an appropriate connection to the dispensing spout connected to the keg spear opening 14 to maintain appropriate pressure internally of the keg to effect the proper pressure balance to cause the contents of the keg to be dispensed as desired by the user.

Figure 2:
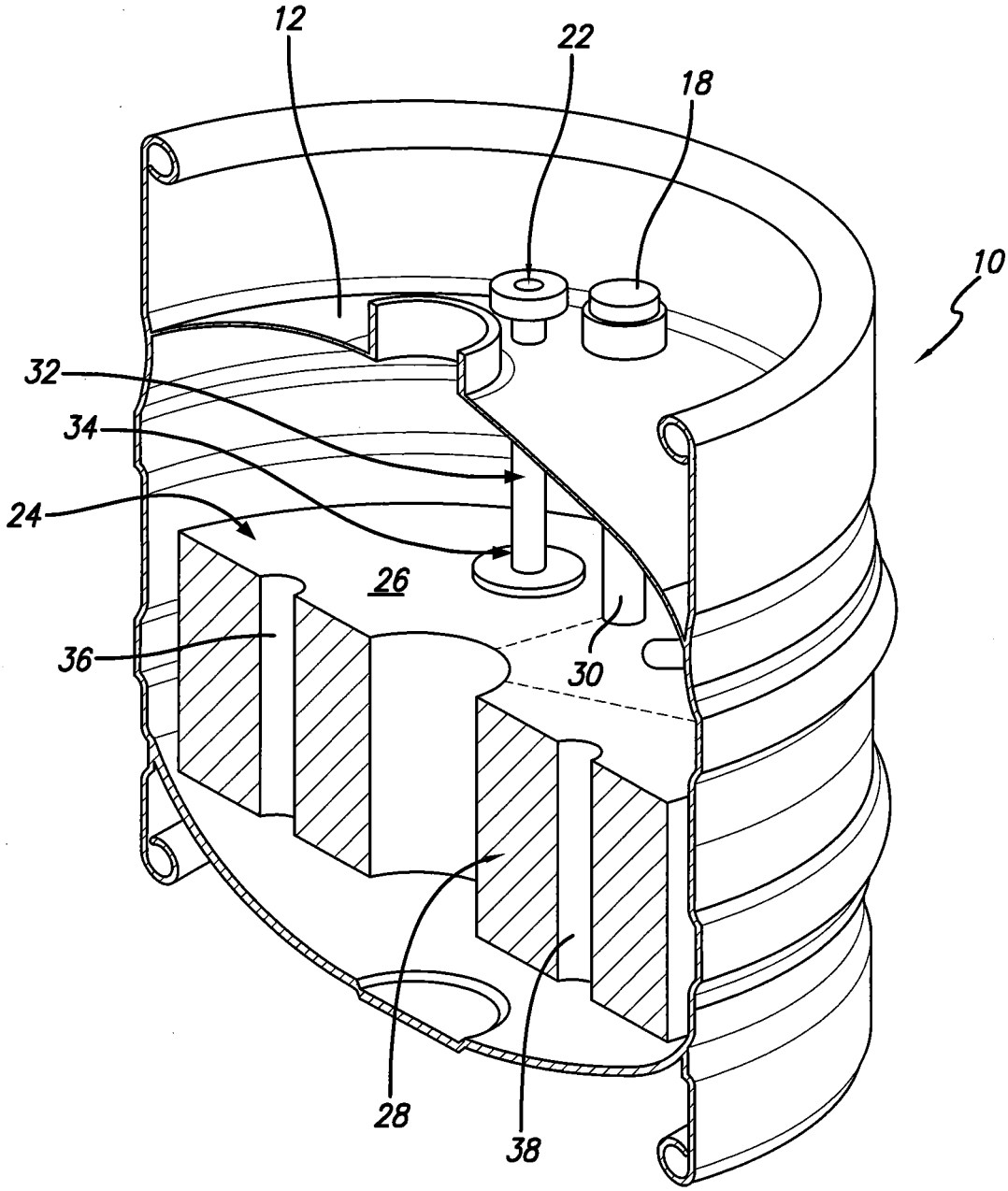
FIG. 2 is a cross-sectional view of a keg of the type as shown in FIG. 1 illustrating the various internal components thereof.

FIG. 2 is a perspective view in cross-section which illustrates the internal components of the keg 10. As is therein shown, the keg 10 having the top 12 includes the gas inlet valves only one of which is shown at 18 in FIG. 2. The dispense gas outlet 22 is also illustrated. As is shown, the heat exchange unit 24 includes a container such as a stainless steel housing 26 within which there is housed segments 28 of compressed activated carbon particles as above described. The cooling gas inlets, such as that shown at 18, is connected to a cooling gas feed tube 30 which is connected to the housing 26 of the HEU 24. This permits the carbon dioxide gas to be inserted through the gas inlet valve 18 so as to be adsorbed by the carbon segments 28. Also when the beverage is to be cooled prior to consumption, the compressed gas within the HEU is released by activating the gas inlet valves as above described to cause desorption of the gas from the carbon. As is also shown, the dispense gas outlet 22 is connected to a dispense gas feed tube 32 which is connected to a dispense gas canister 34. The dispense gas canister 34 also contains compressed activated carbon particles which adsorb carbon dioxide gas. During the time the contents of the keg is being dispensed, the carbon dioxide gas is automatically released from the canister and enters the keg to maintain the pressure therein in proper balance to allow dispensing of the beverage. Thus it can be seen that the canister 34 is also charged with the carbon dioxide gas which is allowed to exhaust from the dispense gas canister and enter the interior of the keg through the dispensing mechanism attached to the keg spear opening 14. As is illustrated, cooling tubes 36 and 38 extend through the heat exchange unit and contribute to the cooling of the beverage which surrounds the heat exchange unit by causing beverage to circulate through the cooling tubes by convection.

Figure 3:
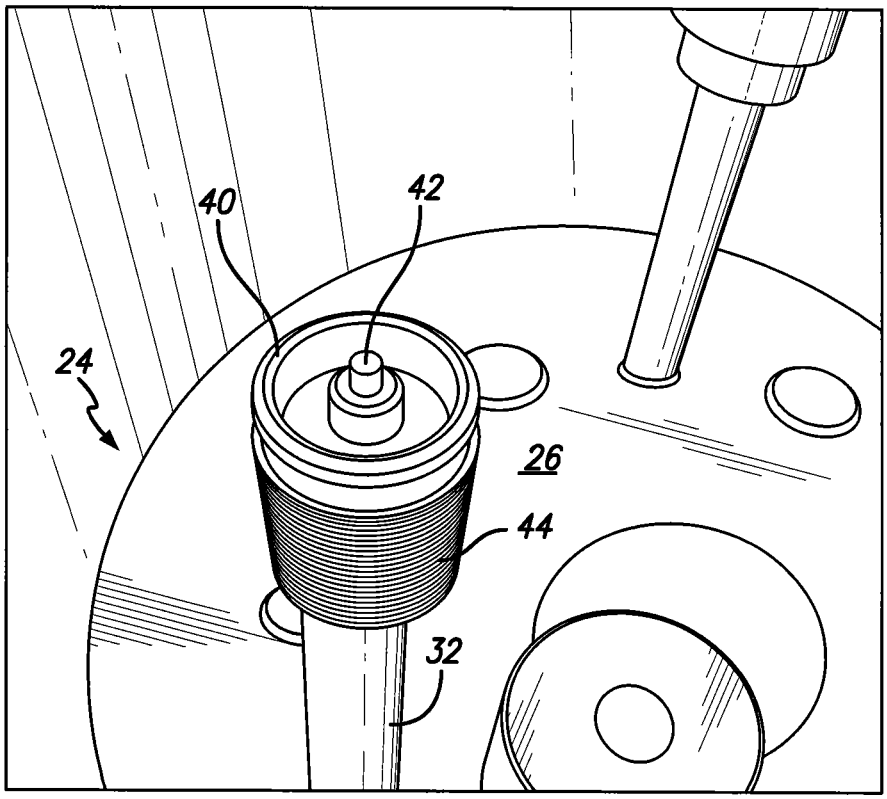
FIG. 3 is a perspective view of a portion of the heat exchange unit contained within the keg and particularly illustrating the valves used for charging the heat exchange unit and for allowing the pressurized gas contained therein to escape to accomplish the desired cooling of the beverage contained within the keg.

Referring now more particularly to FIG. 3, there is illustrated a valve 40 which is attached to the gas feed tube 32 which in turn is attached to the HEU housing 26. By activation of the valve 40 by depressing the valve stem 42, carbon dioxide gas under pressure may be inserted into the HEU 24 to be adsorbed by the carbon segments 28 as above described. Alternatively, when the beverage contained in the keg is to be cooled, prior to consumption, the valve stem 42 may be depressed allowing the carbon dioxide gas under pressure contained within the heat exchange unit 24 to desorb and exhaust to the atmosphere thereby cooling the beverage prior to consumption.

Figure 4:
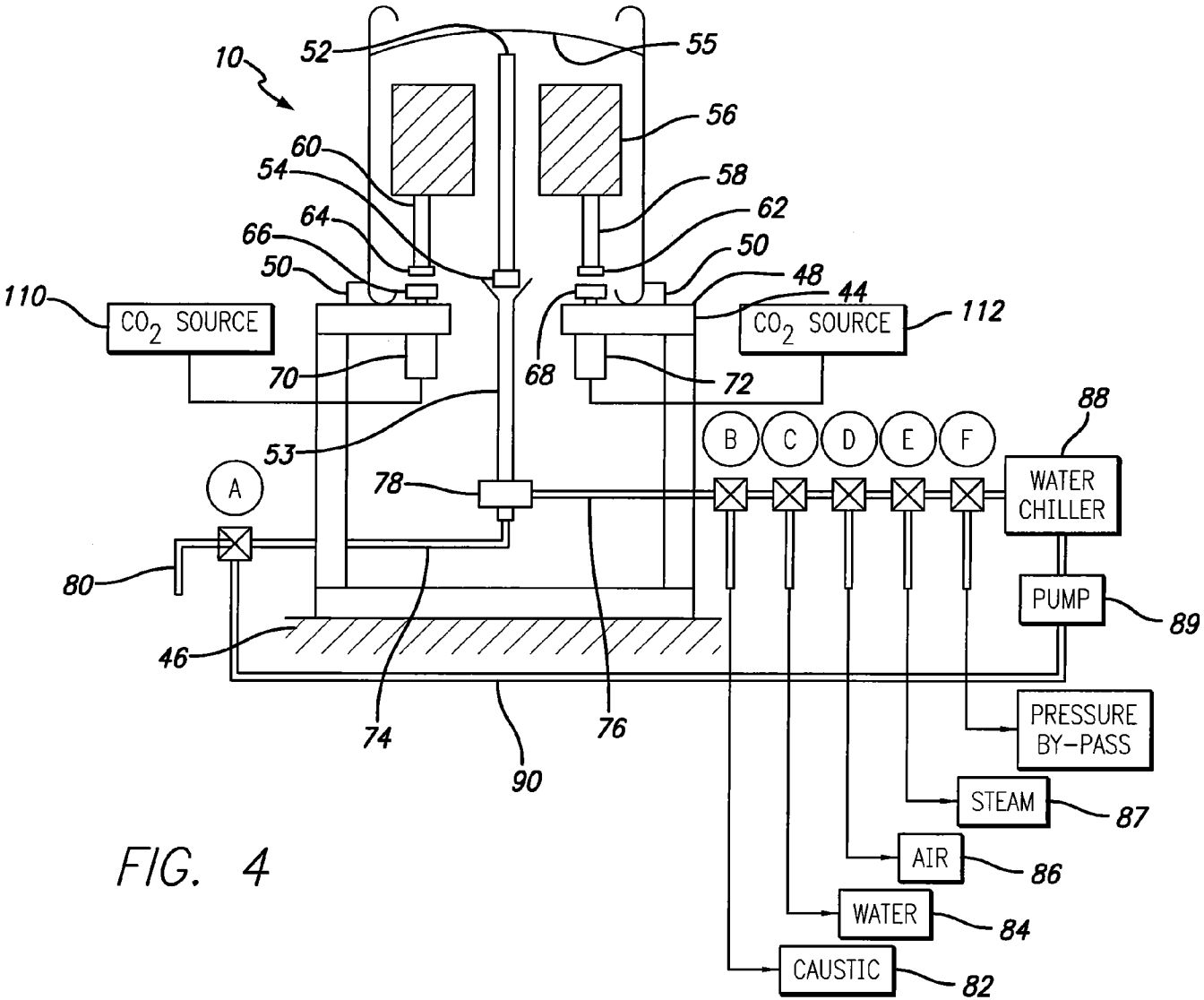
FIG. 4 is a schematic diagram illustrating the cleaning apparatus utilized in accordance with the principles of the present invention.

The keg as above described and illustrated may be cleaned, sanitized and recharged with carbon dioxide utilizing the apparatus as schematically illustrated in FIG. 4 to which reference is hereby made. As is therein shown, a machine platform 44 is supported upon a floor 46 or other appropriate supporting structure. The keg 10 to be cleaned, sanitized and recharged in accordance with the present invention is inverted and positioned upon the top 48 of the platform 44 and is appropriately located by centering pads 50 so that the keg 10 is appropriately positioned over the various connections that are required as will be explained hereafter. The connections which are required include an appropriate fluid conduit 53 which is connected to the keg spear opening 54 to which is connected the keg spear or riser 52 that extends upwardly as viewed in FIG. 4 toward the bottom 55 of the keg 10. The HEU which is contained internally of the keg 10 is shown schematically at 56. Connected to the HEU are the gas feed tubes 58 and 60 as above described and each of these includes a gas inlet valve 62 and 64. It will be understood that there are four such gas inlet valves to accommodate the three feed tubes and the dispense gas canister as above described. The apparatus of FIG. 4 includes gas filling heads 66 and 68 which engage the gas inlet valves 62 and 64 (again there are four of these although only two are shown in FIG. 4). Gas head clamp cylinders 70 and 72 are shown in FIG. 4. These gas head clamp cylinders engage the gas filling heads and are used to raise and lower these gas filling heads and are adaptors and assure an air-tight connection between the gas filling heads and the valves so as to prevent any gas loss caused by a flow around the valves during the recharging operation during which carbon dioxide under pressure is inserted into the HEU 56. A source of carbon dioxide gas 110 and 112 is connected to the gas filling heads 66 and 68 respectively through the gas head clamp cylinders 70 and 72. In the preferred embodiment of the present invention there are four separate sources of carbon dioxide gas, or alternatively, four connections to a single source.

Fluid conduits 74 and 76 are connected to a junction 78 which in turn communicates with the fluid conduit 53 connected to the keg spear opening as described. Conduit 74 is in turn connected to an appropriate valve A which functions to allow fluid that has been inserted into the keg 10 to be deposited to an appropriate outlet conduit 80 which is connected to a drain as will be described in more detail hereinafter. The conduit 76 is connected to a plurality of valves indicated at B, C, D, E and F. Valve B is connected to a source 82 of caustic solution, valve C is connected to a source 84 of water, valve D is connected to a source 86 of air under pressure and valve E is connected to a source 87 of steam. Valve F is a check valve which functions as a backflow preventer and is utilized to prevent the air, water, caustic and steam from entering the water chiller 88 during the cleaning and sanitizing operation of the interior of the keg 10.

As will be described more in detail hereinafter, an additional conduit 90 is connected between the water chiller 88 and the valve A and will be utilized to circulate water in a closed loop from the keg 10 through the water chiller during the recharging of the HEU 56 with the carbon dioxide gas.

Figure 5:
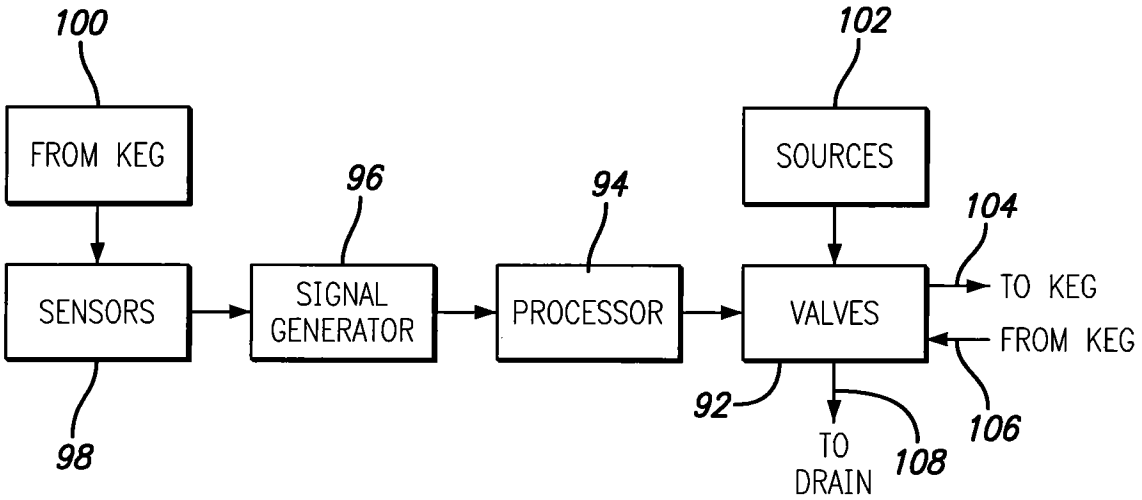
FIG. 5 is a block diagram illustrating the controls for the system as illustrated in FIG. 4.

As shown in FIG. 5, the valves A, B, C, D, E and F are illustrated by the block 92. These valves are controlled during the cleaning and recharging operations of the keg 10 by an appropriate data processor 94 such as a micro processor which has been properly programmed to activate the valves in the desired sequence as will be described more fully below during discussion of the operation of the system. The processor 94 receives signals from a signal generator 96 which in turn is activated by signals received from sensors 98 that are positioned at various points in the system and adjacent the keg and are coming from the keg as shown at 100. The valves when properly sequenced allow the material such as the caustic, water, steam and air from the sources as above described and illustrated in the block 102 of FIG. 5 to enter the system. This will cause the various elements such as the caustic, water, steam and air to be delivered to the keg as shown at 104 or from the keg as shown at 106 to be deposited to the drain as shown at 108. The data processor 94 may be programmed to function in conjunction with the signals provided from the sensors 98 and the signal generator 96 to activate the valves within a particular sequence or alternatively may also be programmed based upon a time sequence depending upon the particular sensors and the parameters which are being utilized to accomplish the desired cleaning and sanitation of the interior of the keg 10 as well as to recharge the heat exchange unit.

Turning now to the operation of the apparatus as shown in FIGS. 4 and 5, the method of the present invention will be discussed in detail. A keg 10 which has been returned by the consumer after consumption of the beverage contained within the keg must be cleaned and sanitized before it can be refilled with the beverage of choice and once again sent to the consumer. The keg 10 will be turned upside down as shown in FIG. 4 and placed upon the platform 44 and properly centered and positioned by the centering pads 50 so that the various elements of the keg are properly positioned over the connections which are to be made to them. The four gas filling heads, two of which are shown at 66 and 68, are raised to engage and be sealed with the valves 62 and 64 in a manner such that there is a gas tight seal between them to preclude loss of the carbon dioxide gas under pressure when it is to be injected into the HEU 56. The fluid conduit 53 will then be securely connected to the keg spear opening 54. This will permit the various sources of cleaning and sanitizing materials to be inserted into the keg for cleaning and sanitizing to be conveyed by way of the fluid conduit 53 and the keg spear 52 into the interior of the keg 10. Once all of the connections are securely in place, all of the valves A through F are checked to be sure that they are in a closed position. This will mean that the conduits between valves B, C, D and E and the junction 78 are open and in communication with each other with the exception of valve F which blocks communication with the water chiller 88. Valve D is then opened to allow air under pressure from the source 86 to pass through valve D to conduit 76 and the junction 78 and into the interior of the keg 10 through the keg spear 52 to drive out any residual beverage that remains in the returned keg. Valve A will be opened to allow the air contained within the keg 10 and any moisture contained therein as a result of the residual beverage in the keg to pass through valve A into the drain. The airflow and the moisture content thereof will be measured in the drainage system to determine when all of the residual beverage has been removed from the system. An appropriate moisture measuring apparatus (not shown) will be associated with the conduit A or with the drain in order to make this determination. That measuring apparatus will provide an appropriate signal as a sensor 98 to the processor 94 when it is determined that the air no longer contains moisture. In response thereto, a signal will be provided from the processor 94 to close valve A. When this occurs air under pressure will continue to be inserted into the interior of the keg 10. The pressure internally of the keg 10 will be measured by an appropriate pressure gauge (not shown) and when it reaches a predetermined value a signal will be provided by the pressure gauge which is a sensor 98 to the signal generator 96 which again causes the processor 94 to apply a signal to close valve D. After this occurs, the pressure within the interior of the keg will be monitored utilizing the pressure gauge to determine whether or not any potential leaks in the keg have been caused by damage in use. If the pressure being measured within the keg with valve A and D closed remains constant for a predetermined period of time, then this will assure that the keg's integrity has not been compromised in any way and that the keg can be safely reused by once again filling it with beverage. When the integrity of the keg has been assured by this test, the processor 94 will provide a signal to open valve A thus allowing the air under pressure within the interior of the keg to be released to exhaust into the drainage system. Once the air has exhausted, valve A will once again be closed.

After the integrity of the keg has been assured value D will again be opened to permit communication through conduit 76 but closed to the air source. Valve E will then be opened to permit high temperature steam under pressure from source 87 thereof to pass through spear 52 into the interior of the keg 10. The high temperature steam is used to insure that any bacteria that may remain in the interior of the keg is killed. After sufficient time has passed to insure the bacteria kill, a signal is generated to open valve A to exhaust the steam from the keg and to also close valve E from communication with the steam source 87.

Thereafter, valve A will once again be closed and valve B will now receive a signal from the processor 94 causing valve B to open. This will allow a caustic solution under pressure from the source 82 thereof to pass through the conduit 76 and the junction 78 and through the keg spear 52 to the interior of the keg 10. The full volume of the inside of the keg will be filled with the caustic solution ensuring the all surfaces within the keg are properly cleaned and sanitized by the caustic solution. Numerous caustic solutions are well known to those skilled in the art. One such caustic solution which may be utilized is a concentrated cleaning solution comprising potassium hydroxide (caustic potash). The pH of the concentrated solution is approximately 10 to approximately 15. As an alternative to the caustic solution, an acidic solution having a pH in the range of approximately 2 to 3 may be utilized. After a sufficient period of time to be sure that the total interior of the keg 10 has been cleaned and sanitized by the caustic solution, valve A will again receive a signal from the processor 94 causing it to open thereby allowing the caustic solution contained internally of the keg 10 to be exhausted through the conduit 80 into the drain, and valve B will receive a signal causing it to close to eliminate further caustic solution entering the system from the source 82 but to be open to communicate with conduit 76.

At this time valve C will receive a signal from the processor causing it to open to allow water under pressure from the source 84 to be transmitted through conduit 76 and the junction 78 to enter the interior of the keg 10 through the keg spear 52. This water will impinge against the bottom 55 of the keg disbursing the water outwardly in all directions allowing it to totally wash the sides of the keg as well as totally surround the HEU and the exterior of the keg spear as well as the gas feed tubes such as shown at 58 and 60. This will cause all of the interior surfaces of the keg and the various parts such as the HEU housing interior thereof to be thoroughly washed by the water under pressure.

This water will flood the inside of the keg with valve A open to remove all residual caustic solution which may be contained internally of the keg and adhering to the surfaces of the keg and the HEU, the external part of the keg spear and the feeding tubes and the like. Thus the entire interior of the keg 10 will be allowed to be flooded with the water to be sure that all of the caustic solution has been washed out of the system. Once an appropriate sensor detects that water being exhausted contains no further caustic, a signal will be applied to valve A closed it. Thereafter, water will continue to be inserted into the system with valve A closed to prevent communication with the conduit 80 and the drain to allow the entire internal part of the system to be filled with water. Valve A will also receive a signal that will position it so that the water internally of the system also now is connected to the conduit 90 and valve F will open to communicate with the water chiller 88 thus causing the system to contain a closed loop recirculation system wherein an appropriate pump 89 will move water through the interior of the keg and through the water chiller 88 in a circulating fashion through the valves A through E, the conduit 76, the junction 78, the conduit 53, and the keg spear 52. It will be recognized by those skilled in the art that the junction 78 will include an appropriate valve and the conduit 53 will have two distinct paths so that the chilled water will be injected into the keg spear on the output side of the pump 89 and withdrawn from the keg spear on the input side thereof. The water chiller 88 will cause the water temperature to drop to a preset level determined by the water chiller 88. The water chiller 88 may include any refrigeration system known to the art which can reduce the temperature of the water being circulated to the desired level. Such systems are well known to those skilled in the art and need not be shown and described here in detail. As a result the water internally of the keg 10 will drop in temperature to this preset level. An appropriate temperature gauge (not shown) will be utilized to ascertain the temperature of the water contained internally of the keg 10. Once the water has reached the predetermined temperature, an appropriate sensor 98 will provide a signal to the signal generator 96 which in turn will activate the processor 94 to provide a signal to valves (not shown) which are connected between the compressed gas sources such as the $CO_2$ sources 110 and 112 to allow the $CO_2$ gas under pressure to enter the interior of the HEU so that the $CO_2$ can be adsorbed by the compressed carbon segments contained therein. As is well known in the art, when the $CO_2$ is inserted into the HEU an exothermic reaction will occur generating a substantial amount of heat. This heat which is generated during the charging cycle with the $CO_2$ entering the HEU will be removed by the cold circulating water which is being pumped in the closed loop system as above described. Through the utilization of this recycled water drawing away the heat while the carbon dioxide gas is charging the HEU enables the recharging of the HEU to take place in a relatively short period of time.

Once the correct amount of carbon dioxide gas has been injected into both the HEU and the dispensing gas canister the system will receive a signal which will close off the recirculation system and will open valve A to the conduit 80 and thus the drainage system allowing the water in the keg and in the pipe system to exit through the conduit 80 and into the drainage system. Valve F will then be closed and thereafter a signal will be applied to valve D to open it to allow a gas under pressure from the source 86 thereof to flow into the keg through the conduit 76 the junction 78 and the keg spear 52 to accomplish drying of the internal components and surfaces of the keg 10. Although the source 86 is designated as air, it should be understood that inert gas such as nitrogen carbon dioxide be substituted for air at this stage to preserve the integrity of the beverage to be subsequently inserted into the container. Once the internal surfaces of the keg 10 have been appropriately dried as ascertained by the moisture detecting sensor, valve D will be closed and the various connections previously made to the components of the keg will be removed thus allowing the four gas filling heads to be lowered and the connection between the fluid conduit 53 and the keg spear opening 54 to be removed. When this occurs the keg 10 is then disengaged from the platform 44 and can be placed on an existing beverage filling line so that it may be refilled with the desired beverage of choice and thereafter returned to the consumer.

There has thus been disclosed an apparatus and a method for cleaning and sanitizing the internal part of a keg and at the same time to permit recharging of the HEU contained within a keg with an appropriate compressed gas such as carbon dioxide so that the keg may be reused a multiplicity of times.

What is claimed is:

1. The method of cleaning and recharging a self cooling beverage container having a heat exchange unit including compressed carbon therein comprising:

connecting a plurality of sources of cleaning and sanitizing fluids through a plurality of valves to said container;

sequentially activating said valves to apply said cleaning and sanitizing fluids to the interior of said container to clean and sanitize the same;

circulating chilled fluid through the interior of said container; and injecting carbon dioxide gas under pressure into said heat exchange unit while said chilled fluid is being circulated through the interior of said container.

2. The method of cleaning and recharging a self cooling beverage container as defined in claim 1 which further includes testing the integrity of the container by filling it with a gas under pressure and measuring the pressure for a predetermined period of time to detect any leakage thereof.

3. The method of cleaning and recharging a self cooling beverage container as defined in claim 1 which further includes cooling said chilled fluid to a temperature sufficient to remove heat generated by said carbon dioxide gas being adsorbed into said compressed carbon.

4. The method of cleaning and recharging a self cooling beverage container as defined in claim 1 which further includes providing a platform for receiving said container, positioning said container on said platform, and connecting a fluid conduit to said container, said conduit being connected to said plurality of valves.

* * * * *